US006085565A

United States Patent [19]

Suda et al.

[11] Patent Number: 6,085,565

[45] Date of Patent: Jul. 11, 2000

[54] EIGHT-ROLLER TYPE ROLLING MILL AND METHOD OF ROLLING USING THE MILL

[75] Inventors: Hiroshi Suda, Chita; Tatsuo Tajima, Nagoya, both of Japan

[73] Assignee: Daido Steel Co., Ltd., Nagoya, Japan

[21] Appl. No.: 09/156,655

[22] Filed: Sep. 18, 1998

Related U.S. Application Data

[63] Continuation of application No. 08/757,879, Nov. 27, 1996, abandoned.

[30] Foreign Application Priority Data

Nov. 30, 1995 [JP] Japan ..... 7-337855

[51] Int. Cl.[7] ..... B21B 1/13

[52] U.S. Cl. ..... 72/224; 72/235

[58] Field of Search ..... 72/224, 235, 250, 72/249

[56] References Cited

U.S. PATENT DOCUMENTS 3,380,278 4/1968 Dilling .
3,861,187 1/1975 Leeuwestein .
4,283,930 8/1981 Hasegawa et al. .
5,363,682 11/1994 Takeda et al. .

FOREIGN PATENT DOCUMENTS 2 312 307 12/1976 France .
58-16709 1/1983 Japan ..... 72/250
778829 11/1980 Russian Federation .

*Primary Examiner*—Lowell A. Larson
*Attorney, Agent, or Firm*—Varndell & Varndell, PLLC

[57] ABSTRACT

A final finish-rolling stand of a rolling machine for producing round bar material is constructed as an eight-roller type rolling machine comprising: front four rollers of "+" distribution and back four rollers of "X" distribution which are contained in one housing block. Only one driving source is used for the rolling machine, and the driving force from the driving source is transmitted to one roller of the front four rollers to forcibly drive this roller. The remaining rollers are freely rotatable and rotate synchronously with transfer of the material being rolled so as to carry out rolling down of the material. Structure of the rolling machine is simple and adjustable range of sizes of the product is wide.

7 Claims, 7 Drawing Sheets

FIG. 5(A)
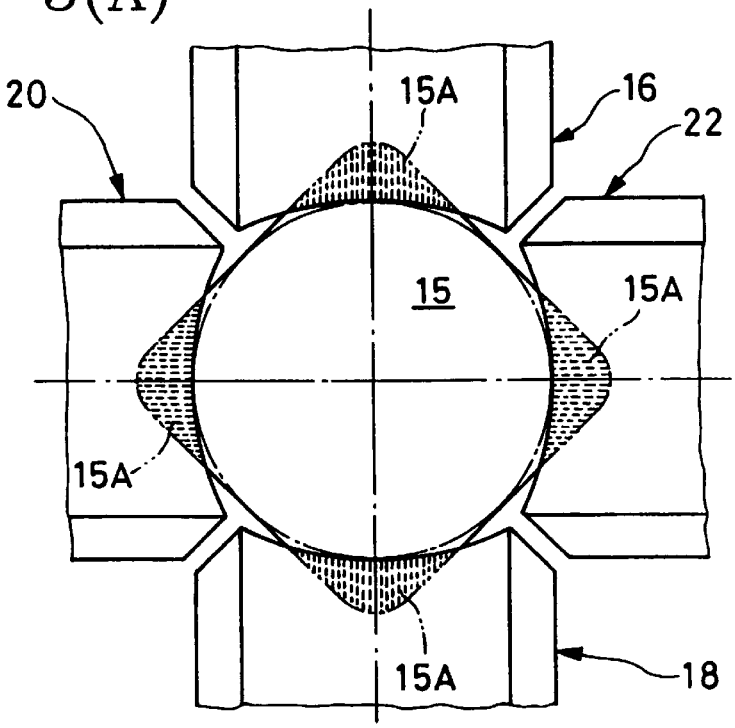
FIG. 5(C)
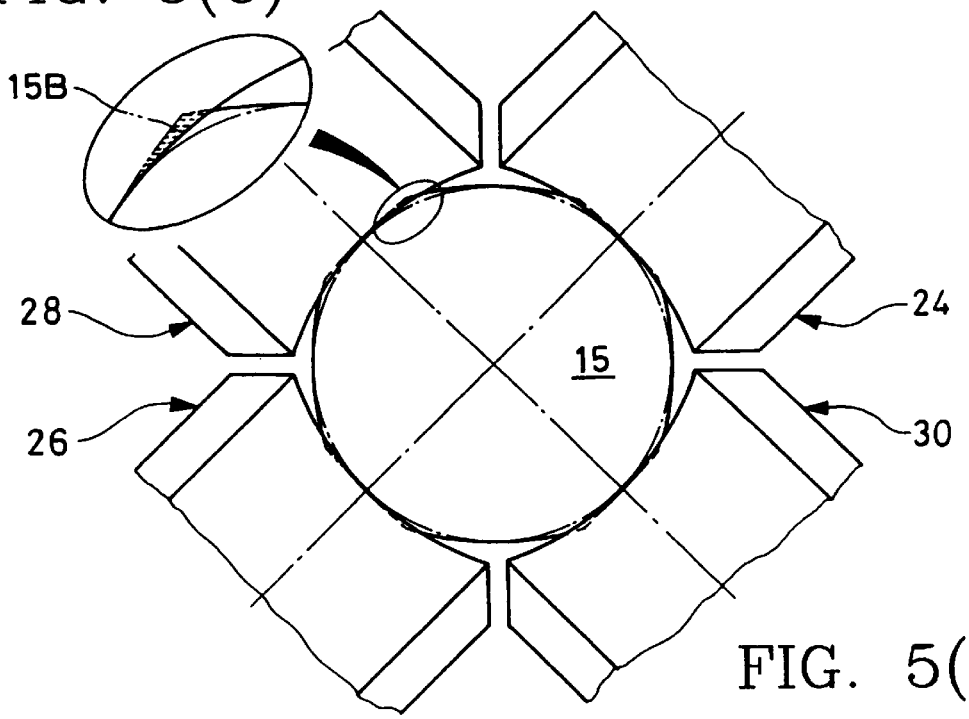
FIG. 5(B)

EIGHT-ROLLER TYPE ROLLING MILL AND METHOD OF ROLLING USING THE MILL

CROSS-REFERENCE TO RELATED APPLICATION

This application is a continuation application of U.S. Ser. No. 08/757,879 filed Nov. 27, 1996, now abandoned.

BACKGROUND OF THE INVENTION

1. Technical Field

The present invention concerns a rolling mill and a method of rolling round steel bars and steel wire using the mill.

2. Prior Art

As the rolling mills for producing round steel bars and steel wire there has been generally used two-roller type rolling mills, in which a pair of rollers oppositely disposed in parallel directions, and the peripheries of the rollers are pressed onto the materials to be rolled so as to roll and elongate them into predetermined sizes.

Such rolling steps using the two-roller type rolling mills are as illustrated in FIG. 7.

The Figure shows an example of round-oval type rolling. According to the conventional technology, as illustrated in the Figure, a material to be rolled 200 is sequentially rolled with rollers 202 to form alternative sections of oval-round-oval-round, and in the final finish-rolling step the material is shaped into round bars or wires of desired sizes.

The two-roller type rolling mills have a drawback that profiled rolls for every sizes are necessary because adjustable size ranges of each roller are small.

For example, in the case of producing a round steel bar of diameter 50 mm, a set of profiled rollers for this size is necessary. Also, in the case of producing a round steel bar of diameter 55 mm, another set of rollers having corresponding sizes is necessary. Thus, in order to produce round steel bars of various sizes many sets of rollers are necessary. Provision and maintenance of the roller sets are troublesome and expensive, and further, changes in the sizes of the steel bars to be produced necessitate set-up operation including change of roller sets. The set-up operation requires time and labor and lowers productivity of rolling operation.

On the other hand, there has been known four-roller type rolling mills, in which two pairs of rollers are installed at every 90° axes disposition and the material is simultaneously rolled by the two pairs of rollers.

Further, it has been practiced to use two sets of the four-roller type rolling mills separately installed with 45° rotated axes. The material to be rolled is firstly rolled down partly with the first four-roller type rolling mill and then, at downstream thereof, the remaining parts or free surfaces of the material is rolled down with the second four-roller type rolling mill.

In the rolling operation using the two sets of four-roller type rolling mills adjustable size ranges are wider, and thus, it is advantageous that round steel bars having different diameters, for instance, 50 mm and 55 mm, can be produced with the same set of roller pairs.

In the above described rolling operation it is necessary to use two sets of the four-roller type rolling mills of complicated structure and having individual driving sources. These factors necessarily require a higher investment. Guiding means to prevent deformation of the material being rolled are necessary between the first and the second four-roller type rolling mills. Also, because the first and the second four-roller type rolling mills are mutually independent, matching of rotating speeds of the rollers of the first and the second four-roller type rolling mills is required. Otherwise, tension and/or compression will be effected to the material being rolled and it will be difficult to carry out desired rolling.

SUMMARY OF THE INVENTION

The object of the present invention is to provide a method and an apparatus for solving the above described problems residing in the conventional rolling technology.

The rolling mill according to the present invention is an eight-roller type rolling mill comprising:

(A) front four rollers comprising the first pair of rollers disposed oppositely with intermediation of a material to be rolled, the axes of the rollers of the first pair being parallel; and the second pair of rollers disposed oppositely with intermediation of said material to be rolled at the same position as that of the rollers of the first pair in the longitudinal direction of said material to be rolled, the axes of the rollers of the second pair being rectangular to the axes of the rollers of the first pair; the first and the second pair of the rollers simultaneously rolling said material to be rolled at the same part in the longitudinal direction of the material;

(B) back four rollers installed in the down stream of the material being rolled comprising the third pair of rollers disposed oppositely with intermediation of said material to be further rolled, the axes of the rollers of the third pair being 45° rotated to those of the rollers of the first and the second pairs; and the fourth pair of rollers disposed oppositely with intermediation of said material to be further rolled at the same position as that of the rollers of the third pair in the longitudinal direction of said material, the axes of the rollers of the fourth pair being rectangular to the axes of the rollers of the third pair; the third and the fourth pair of the rollers simultaneously rolling said material to be further rolled at the same part in the longitudinal direction of the material; and (C) a housing block in which the front four rollers and the back four rollers are installed closely.

BRIEF EXPLANATION OF THE DRAWINGS

FIGS. 5(A), 5(B), and 5(C) illustrate changes in the shape of the material under rolling by the eight-roller type rolling mill shown in FIG. 1;

DETAILED EXPLANATION OF THE PREFERRED EMBODIMENTS

Figure 1:
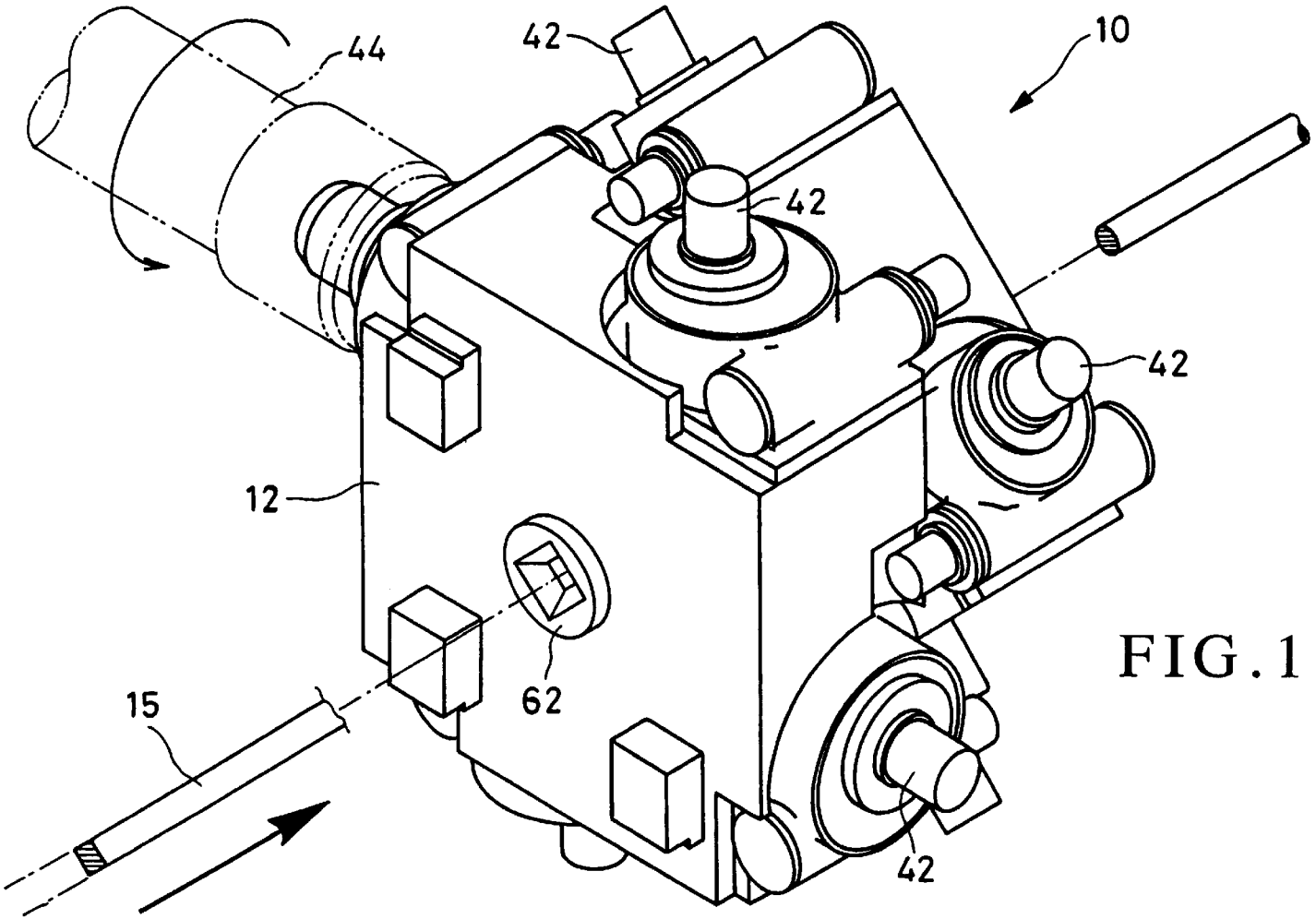
FIG. 1 illustrates an appearance of an example of an eight-roller type rolling mill according to the invention.

An embodiment of the rolling mill according to the present invention is characterized in that, in the rolling mill defined above, only one driving source is provided as a driving source for the rollers at rolling of said material to be rolled. The driving source drives any one roller of the front four rollers, while the remaining three rollers of the front four rollers and all the four rollers of the back four rollers are kept substantially free rotating so that the free rotating rollers may rotate following advance of said material to be rolled.

A further embodiment of the rolling mill according to the present invention is characterized in that, in the second rolling mill described above, driving sources of small driving force are provided so as to idle-rotate the three free rollers of the front four rollers and all the four free rollers of the back four rollers, which are free rotating, in the same rotating direction as that under rolling prior to engagement of said material to be rolled by the rollers.

Still other embodiment of the rolling mill according to the invention is characterized in that, in any one of the rolling mill described above, a support guide is provided at the inlet of said material to be rolled to the front four rollers; and that the distance between shafts of the front four rollers and shafts of the back four rollers is so minimized that no guide is necessary therebetween and the material being rolled is directly passed from the front four rollers to the back four rollers.

Still other embodiment of the rolling mill according to the invention is characterized in that, in any one of the rolling mill described above, all the eight rollers are supported by cantilever method in which rotating shafts extending in single sides from the rollers are supported rotatably.

Still other embodiment of the rolling mill according to the invention is characterized in that, in any one of the rolling mill described above, said rotating shafts of the rollers are supported by eccentric sleeves in the manner that the rotating shafts are biased from the rotation center of said eccentric sleeves so that the roller spacing may be adjustable by rotation of the eccentric sleeves.

The method of the present invention concerns a method of finish rolling of round steel bars or steel wire using a rolling mill of any embodiments comprises: with use of rollers having peripheries which form a round hole corresponding to the final section of the product, supplying first the material to be rolled, which is provisionally rolled to a square bar, to the front four rollers to have the material engaged by the four rollers in such a manner that ridges of the square bar are positioned at the middle of width of the hole so as to roll down the ridges with the front four rollers; rolling down the remaining free surfaces of the bar with the back four rollers, and thus, finish-rolling the bar to give the final round section thereto.

As described above, the basic embodiment of the apparatus of the invention concerns an eight-roller type rolling mill in which the front four rollers disposed in every 90° around the material to be rolled and the back four rollers disposed with 45° rotation to the front four rollers are contained in one housing block. The invention replaces the two sets of the four-roller type rolling mills required by the conventional technology with one set of this eight-roller type rolling mill, and thus, factory arrangement may be simplified and investment will be decreased.

In the second embodiment of the invention the eight-roller type rolling mill uses single driving source as the driving source, which drives only one roller of the front four rollers, and the remaining three rollers of the front four rollers and all the four rollers of the back four rollers freely rotate following supply of the material being rolled. This driving system makes it possible to use only one driving source and to simplify the mechanism of transmitting driving force from the driving source to the rollers. Thus, the structure of eight-roller type mill of the invention, which may otherwise be complicated, can be simplified.

In addition, the fact that rotating speeds of the rollers are synchronized with the advancing speed of the material to be rolled surely prevents the material from being compressed or stretched, and therefore, rolled products are of good quality.

The third embodiment of the invention uses driving sources of small driving force to idle-rotate the free rotating rollers in the same directions as those under rolling prior to engagement of the material to be rolled by the rollers. This minimizes resistance or shock at engagement of front end of the material by the rollers, particularly, by the back four rollers, so that rolling may proceed smoothly.

After engagement of the material to be rolled, driving force for idle-rotation of the rollers may be removed.

In the fourth embodiment of the invention, the rolling mill is provided with, on one hand, a support guide at the inlet of the material to be rolled to the front four rollers, and on the other hand, no guide is provided between the front four rollers and the back four rollers so that the material being rolled is directly passed from the front four rollers to the back four rollers. This guideless system further simplifies structure of the mill. Because of close installation of the front four rollers and the back four rollers in one housing block, the material being rolled is readily transferred from the front four rollers to the back four rollers. The support guide at the inlet to the front four rollers guides the material to be rolled for engagement by the front four rollers.

The fifth embodiment of the invention is characterized in that all the rollers are supported by cantilever method. This makes the structure of the rolling mill simpler in comparison with ordinary supporting method in which rotating shafts of each rollers extend in both the sides of the rollers and the both ends of the shafts are supported rotatably.

The sixth embodiment of the invention is characterized in that the rotating shafts of the rollers are supported by eccentric sleeves in the manner that the rotating shafts are biased from the rotation center of the eccentric sleeves so that roller spacing may be adjustable by rotation of the eccentric sleeves. Easy adjustment of roller spacing by rotation of the eccentric sleeves facilitates rolling of round steel bars and steel wires of various sizes in wide range The method of finish-rolling of the present invention uses one of the above described eight-roller type rolling mills. In the method the material to be rolled is provisionally rolled to a square bar and is first rolled by the front four rollers to roll down the ridges of the square bar, and then to roll down the remaining free surfaces of the bar by the back four rollers, and thus, to finish roll to give final round section to the bar.

Usually, in the case of producing steel bars having a round section as the final shape, it has been practiced to previously roll the material to a round section prior to finish rolling, and to finish roll the round bars with a four-roller rolling mill. Two-roller type rolling mill is often used in the provisional rolling step to gradually decrease the diameter of the round bars On the other hand, it has been also practiced to use rollers having square profiles to roll square steel bars and wires.

It is advantageous that the present method can use conventional square profile rollers prior to finish rolling with an eight-roller type rolling mill of the invention, and can finally produce round steel bars and steel wires of desired sizes.

EXAMPLE

Figure 3:
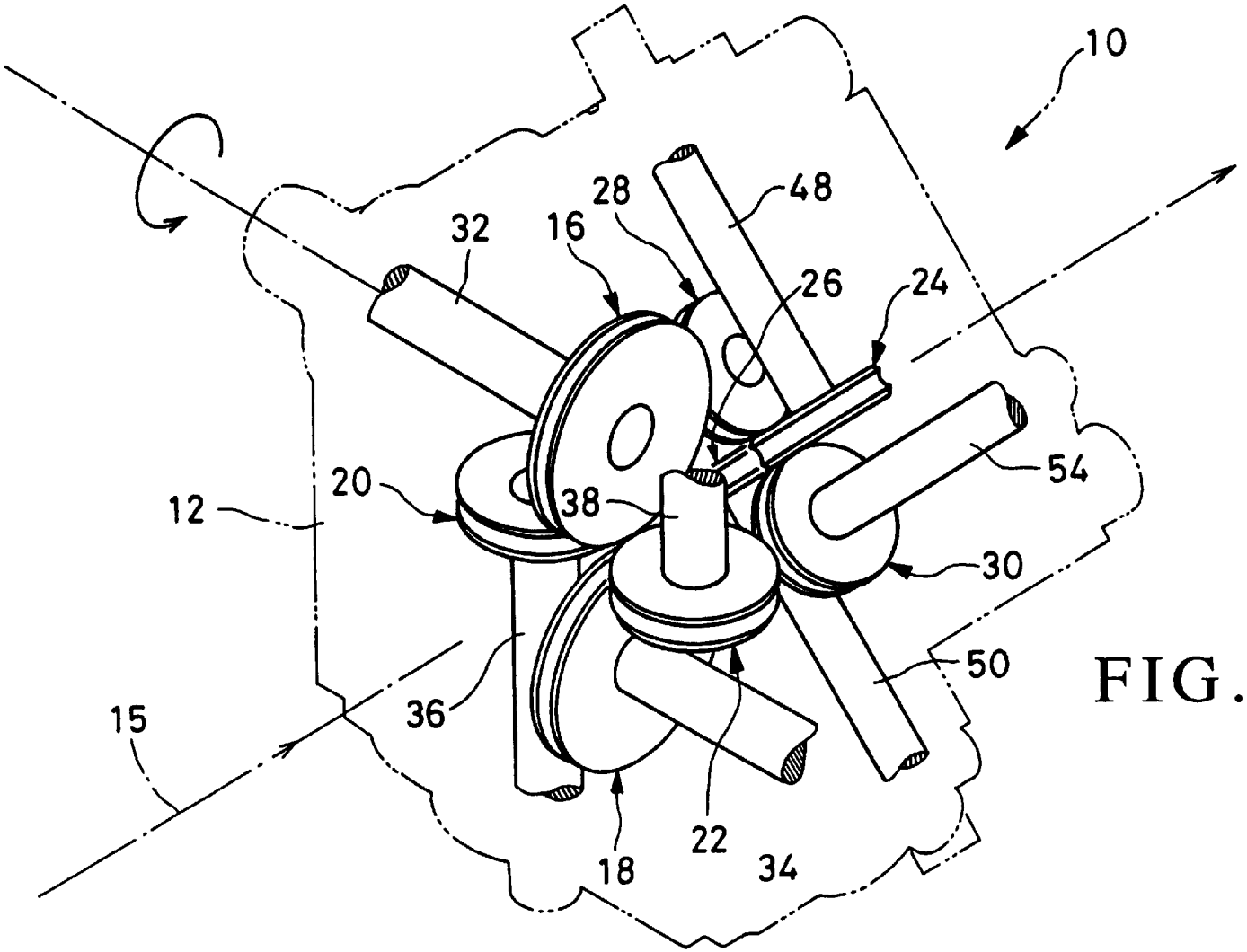
FIG. 3 is a perspective view of the roller disposition in the rolling mill shown in FIG. 1.

An example of the present invention will be explained with reference to the drawings below:

In FIG. 1, numerical reference 10 refers to an eight-roll type rolling mill according to the invention having a housing block 12, in which front four rollers and back four rollers are installed (see also FIG. 3).

Figure 2A:
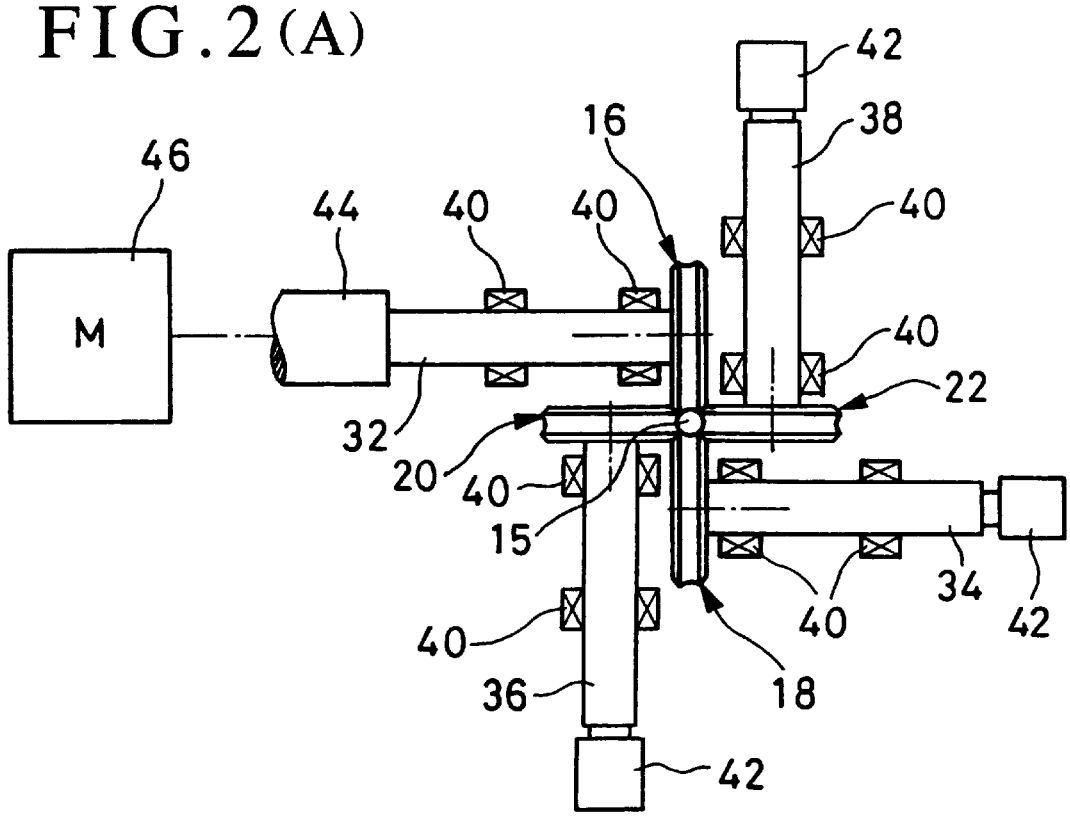
FIGS. 2(A) and 2(B) illustrate disposition of rollers in the rolling mill shown in FIG. 1.

The front four rollers comprises, as also shown in FIG. 2(A), the pair of the first rollers 16, 18 oppositely disposed up and down of the material being rolled 15 and the pair of the second rollers 20, 21 also oppositely disposed right and left of the material being rolled 15.

The pair of the first rollers 16, 18 is disposed in the direction where the rotating axes are horizontal and the pair of the second rollers 20, 22 is disposed in the direction where the rotating axes are vertical, namely, rectangular to the first rollers 16, 18

In other words, the front four rolls are in "+" disposition.

These rollers 16, 18, 20 and 22 have profiles of recessed curve (an arc of a circle) at the peripheries, which form a space for passing the material being rolled 15.

From front four rollers 16, 18, 20 and 22 of the "+" disposition rotating shafts 32, 34, 36 and 38 fitted to the rollers extend only in one direction of the axes which are rotatably supported by journals 40 inside the housing block 12.

In other words, each roller 16, 18, 20 and 22 are supported by cantilever method.

Of the four rollers 16, 18, 20 and 22 rollers 16 and 18 are of larger diameters in comparison with the other rollers 20 and 22. A driving motor 46 as a single and main driving source is coupled to rotating shaft 32 extending from the larger diameter roller 16 through intermediation of driving shaft 44 and a coupling (not shown) so as to transmit the driving force from the driving motor 46 to the larger diameter roller 16.

Hydraulic motors 42 of low driving force are coupled to the ends of rotating shafts of the other rollers 18, 20 and 22. These hydraulic motors 42 are for causing idle rotation of rollers 18, 20 and 22 into the same rotating directions as those under rolling prior to engagement of the material to be rolled 15 by the rollers.

Figure 2B:
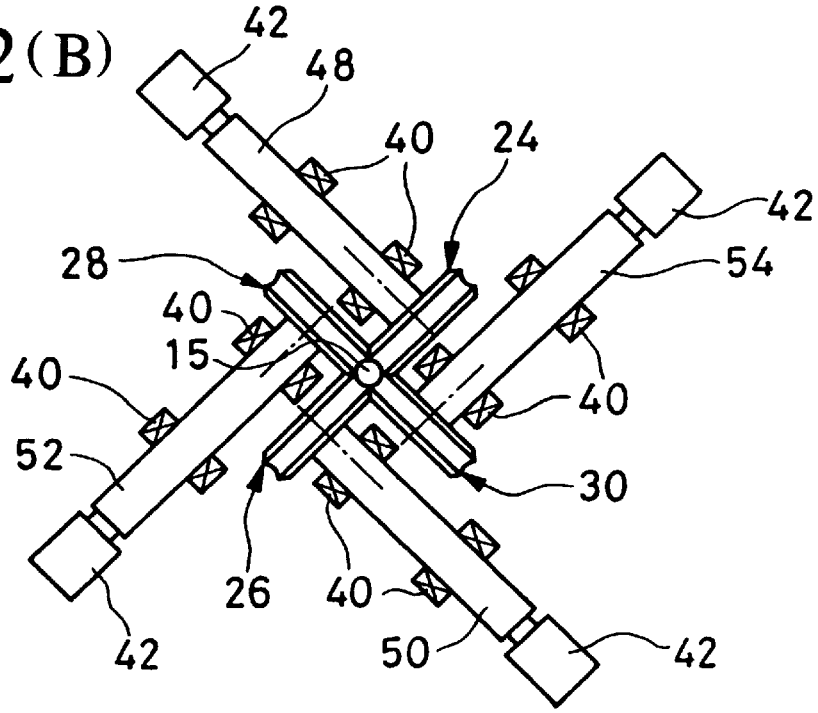

On the other hand, in the above described back four rollers, as illustrated in FIG. 2(B) and FIG. 3, the third rollers 24, 26 and the forth rollers 28, 30 are disposed in the direction 45° rotated to the first rollers 16, 18 and the second rollers 20, 22 so that the rollers are in "X" disposition as a whole.

The four rollers 24, 26, 28 and 30 of the back four rollers are of the same diameters which is smaller than that of the rollers 20, 22 of the front four rollers. The distances between the front rollers and the back rollers should be minimized and the profiles of the outer peripheries are also of the recessed curve (arc of a circle).

The back four rollers of "X" disposition are installed separately to the front four rollers of "+" disposition, and all the rollers 24, 26, 28 and 30 are supported in substantially freely rotatable condition.

In other words, rotating shafts 48, 50, 52 and 54 fixed to the rollers 24, 26, 28 and 30 respectively extend in one direction of the axes, which are supported by journal 40 in housing block 12 in cantilever method. To the ends of each rotating shafts 48, 50, 52 and 54 hydraulic motors 42 of small driving force are connected for idle rotation of the rollers in the direction of rolling action prior to rolling.

Figure 4:
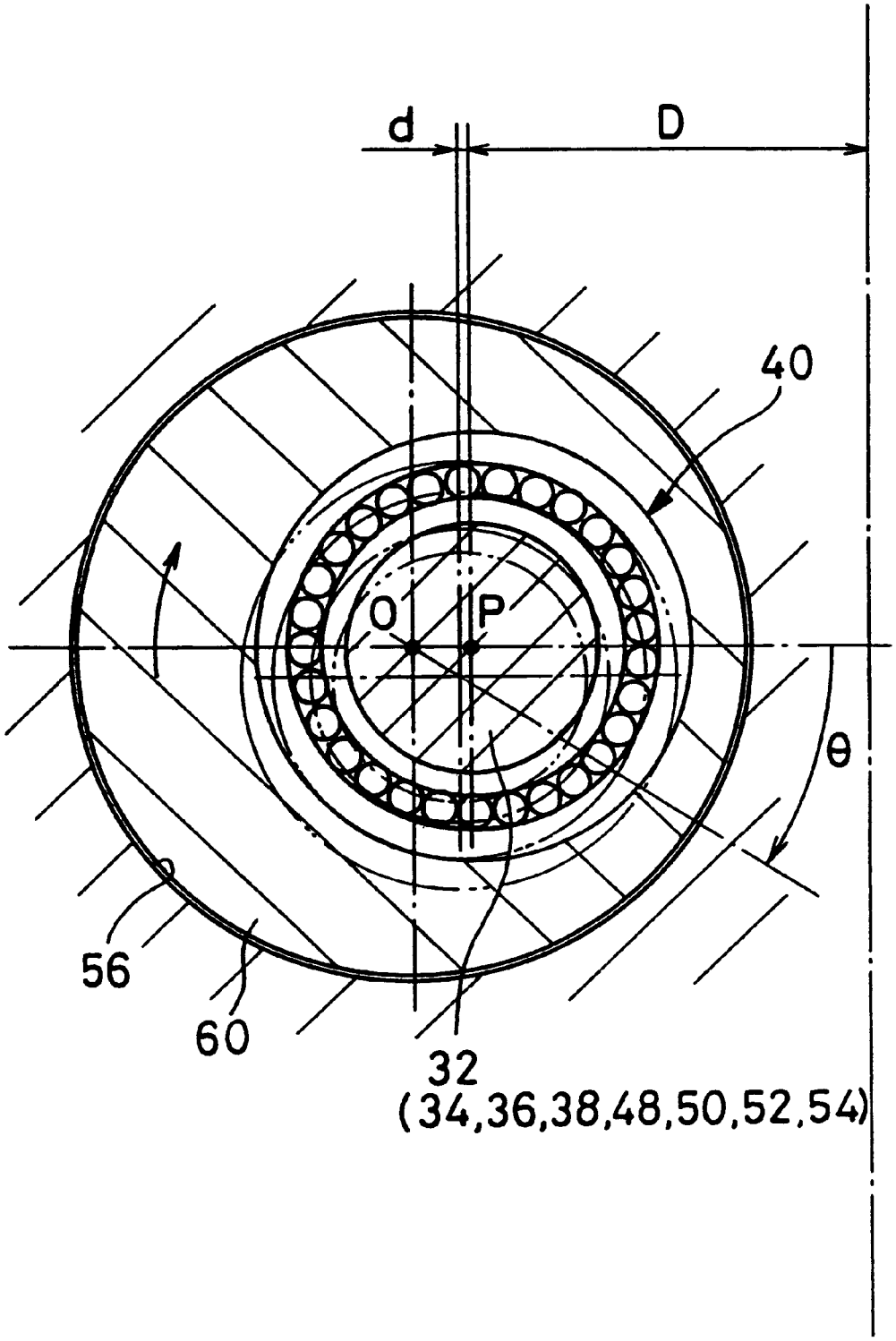
FIG. 4 is an enlarged sectional view of supporting structure with eccentric sleeves for rotating shafts of each rollers in FIG. 2 and FIG. 3.

In the housing block 60 rotating shafts 32, 34, 36, 38, 48, 50, 52 and 54 of the above mentioned front four rollers 16, 18, 20 and 22 of "+" disposition and back four rollers 24, 26, 28 and 30 of "X" disposition are supported rotatably in an eccentric location by an eccentric sleeve 60 which is rotatably fixed in hole 56 (see FIG. 4) through the intermediation of journal 40.

In other words, each rotating shafts 32–38 and 48–54 are supported in the location in which the axis P is eccentric from rotating center O of the eccentric sleeve 60. As the result axes of the rotating shafts 32–38 and 48–54 change as the eccentric sleeve 60 rotates, and therefore, locations of the corresponding rollers move. Thus, roller spacing can be adjusted by rotation of the eccentric sleeve 60.

As shown in FIG. 1, support guide 62 is provided at the entrance of the material to be rolled 15 on the housing block 12.

On the other hand, no guide is provided between the front four rollers and the back four rollers, and thus, the material being rolled is directly passed from the front four rollers to the back four rollers.

The present method of rolling round bars using the above described eight-roller type mill will be explained in detail with reference to FIGS. 5(A) and 5(B) and FIG. 6.

Figure 6:
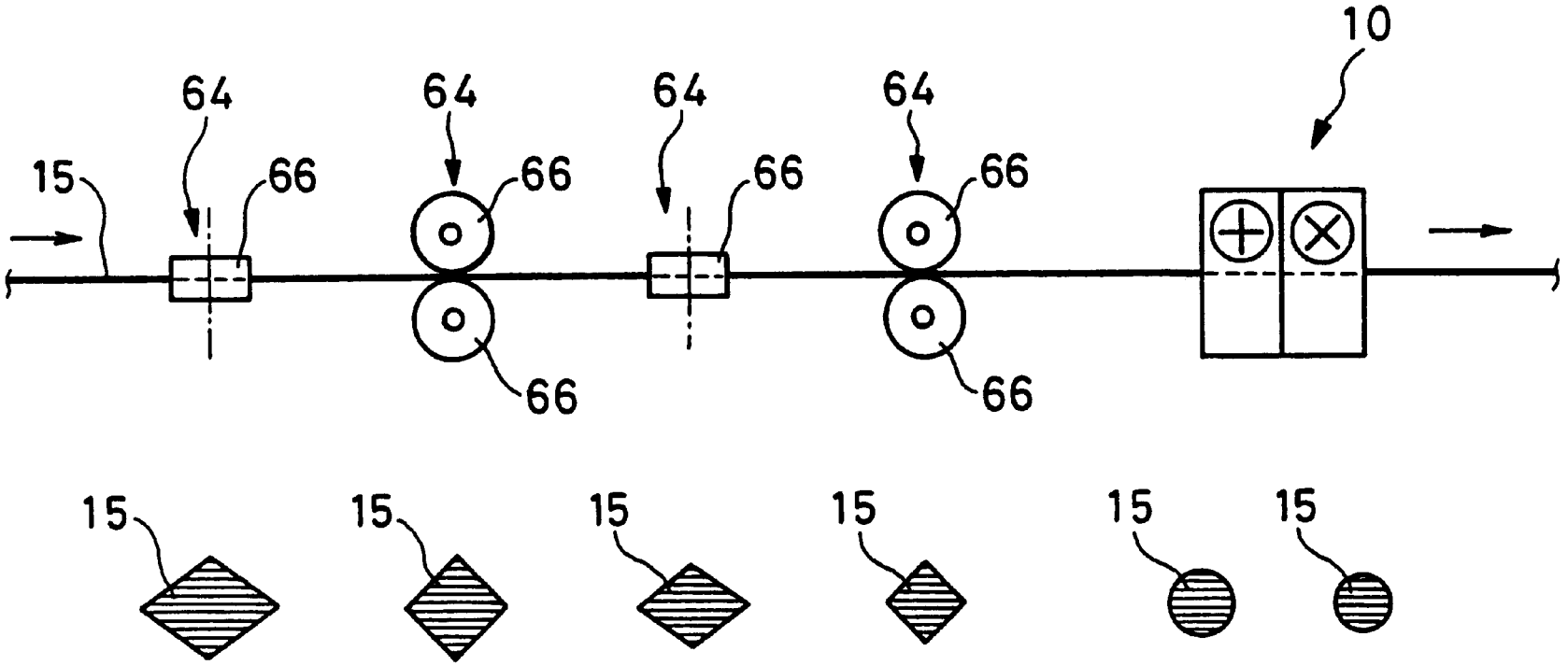
FIG. 6 shows sequence of steps of rolling according to the present invention using the rolling mill of FIG. 1.
Figure 7:
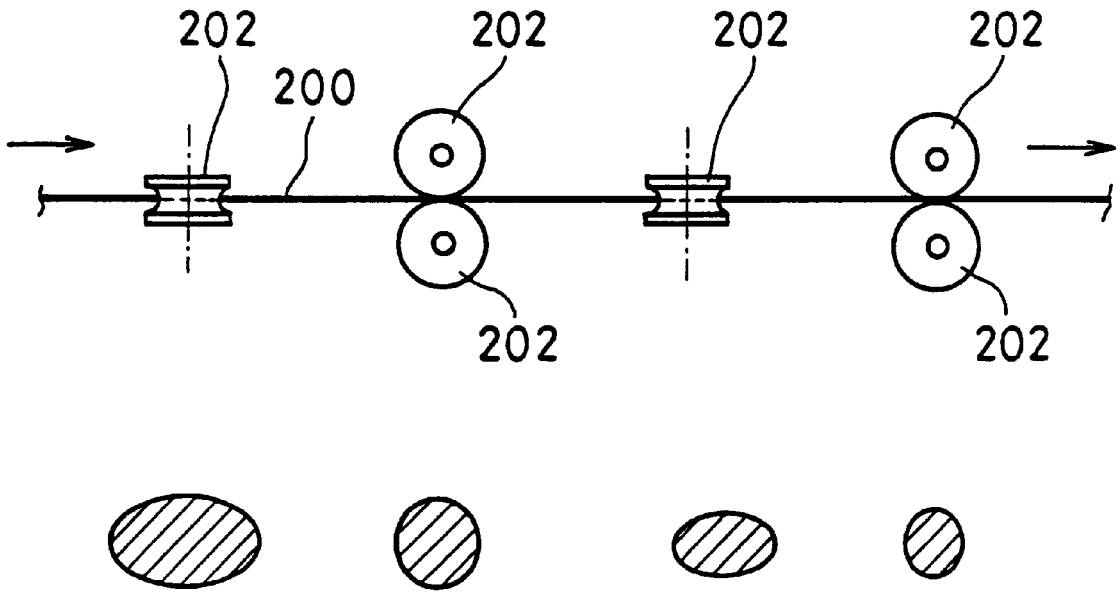
FIG. 7 explains the conventional rolling steps.

As shown in FIG. 6, in the provisional rolling steps prior to the finish rolling by the eight-roller type mill the material 15 is rolled by group of plural two-roller type mills 64, each of which have oppositely disposed pair of rollers, to change the sectional form in rhombus-square-rhombus-square sequence, and the size thereof is gradually decreased. Finally, the material is finish rolled by the eight-roller mill 10 to round bars.

FIGS. 5(A) and 5(B) show the change in the profiles of the material to be rolled 15 at the finish rolling in the eight-roller mill 10.

As shown in FIG. 5(A), in the present method, firstly corners 15A (See FIG. 5(C).) of the material to be rolled 15 (See FIG. 5C) are rolled down by the front four rollers of "+" disposition. In this step only the large diameter roller 16 of the front four rollers is driven to rotate by the driving motor 46. The others, rollers 18, 20 and 22, are freely rotatable and are forced to rotate following supply of the material to be rolled as it is engaged in the rollers.

The freely rotatable rollers 18, 20 and 22 are idle rotated prior to engagement of the material to be rolled 15 by the hydraulic motors 42 of small driving force in the same direction as those for rolling. The manner of engagement of the material to be rolled by the front four rollers substantially minimizes resistance and shock at the engagement, and thus enables smooth engagement of the material.

The material which passed through the front four rollers is subsequently put into the back four rollers as shown in FIG. 5(B). The remaining four free surfaces, i.e., the parts shown in the FIG. 5(B) with reference numerical 15B are rolled down, and thus, finish rolled into a round section, or more strictly, near circle-octagonal shape.

At this stage of rolling by the back four rollers driving force from driving motor 46 is not transmitted to the rollers 24, 26, 28 and 30. These rollers are forced to rotate due to engagement of the material being rolled 15 following advance of the material and roll down it.

Accordingly, rotating speed of the back four rollers 24, 26, 28 and 30 is exactly synchronized with advancing speed of the material being rolled. As the results, neither compression nor tension is posed on the material being rolled 15, and thus, the material receives preferable rolling.

It should be noted that, also at rolling by the back four rollers, the rollers 24, 26, 28 and 30 are idle rotated by hydraulic motor 42 in the same direction as the rotation at rolling prior to engagement with the material being rolled 15. Accordingly, when the material being rolled 15 from the front four rollers is engaged by the back four rollers, there occurs substantially no resistance and shock, and thus the material being rolled 15 is smoothly engaged by the back four rollers.

As described above the rolling mill 10 of the invention is constructed by containing the front four rollers of "+" disposition in which the rollers are disposed with every 90° rotation around the material to be rolled 15 and the back four rollers of "X" disposition in which the rollers are disposed with 45° rotation to the corresponding front four rollers in one housing block 12 to form an eight-roller type mill. While the conventional technology used two sets of four roller type mills, the invention makes it possible to use only one mill, and thus factory arrangement may be simplified and investment will be decreased.

The eight-roller type rolling mill 10 uses only one driving source, and the rollers other than one driving roller 16, rollers 18, 20, 22, 24, 26, 28 and 30 are forced to rotate following supply of the material to be rolled 15. The mechanism of transmitting driving force from the driving source to the rollers may be simple, and thus, the structure of eight-roller mill of the invention, which may otherwise be complicated, can be simplified.

The fact that the rotating speeds of the rollers are synchronized with the advancing speed of the material being rolled 15 prevents the material to be rolled from being compressed or stretched.

In the exemplified rolling mill 10 the free rotating rollers 18 to 30, particularly, four rollers 24 to 30 of the back four rollers, are driven by a hydraulic motor 42 of small driving force to idle-rotate prior to engagement of the material being rolled 15. Thus, resistance or shock at engagement of the material 15 is minimized so that the material 15 may be smoothly engaged.

The illustrated rolling mill has no guide between the front four rollers and the back four rollers, and therefore, the structure is simple. Further, all the rollers of the mill are supported by cantilever method. This supporting method also simplifies structure of the roller supporting parts, and as the results, total structure of the eight-roller type rolling mill 10 is simple.

The rotating shafts of the rollers are supported by eccentric sleeves 60, and positions of the roller shafts in the direction lateral to the shafts may be adjustable by rotation of the eccentric sleeves 60. Due to ready adjustment of roller spacing by rotation of the eccentric sleeves 60 it is easy to cope with rolling of round steel bars and steel wires of various sizes.

In the present method of rolling the material to be rolled 15 is shaped to square section in the provisional rolling step prior to finish rolling carried out in the eight-roller type rolling mill 10, and then, the material 15 of square section is passed in the eight-roller type rolling mill 10 for finish rolling to give the final round section. This method brings about benefit that conventional square profile rollers may be used for the provisional rolling to produce final product bars of round section.

In other words, although the conventional technology requires provision of two kinds of rollers having round and square profiles, respectively, corresponding to the cases of rolling round section products and the cases of rolling square section products, the present method makes it possible to roll products having round section as the final shape even using rollers of profiles for shaping the material to square section.

The present invention has been described above in detail. The explanation is, however, just for exemplification and the present invention can be constructed and practiced in various embodiments without departing from the spirit of the invention.

What is claimed is:

1. An eight-roller type rolling mill comprising:

(A) front four rollers comprising a first pair of rollers disposed oppositely with intermediation of a material to be rolled, axes of the rollers of the first pair being parallel; and a second pair of rollers disposed oppositely with intermediation of said material to be rolled at a same position as that of the rollers of the first pair in a longitudinal direction of said material to be rolled, axes of the rollers of the second pair being perpendicular to the axes of the rollers of the first pair, the first and the second pair of the rollers simultaneously rolling said material to be rolled at the same point in the longitudinal direction of the material;

(B) back four rollers installed in the down stream of the material being rolled comprising a third pair of rollers disposed oppositely with intermediation of said material to be rolled, axes of the rollers of the third pair being 45° inclined to those of the rollers of the first and the second pairs; and a fourth pair of rollers disposed oppositely with intermediation of said material to be further rolled at a same position as that of the rollers of the third pair in the longitudinal direction of said material, axes of the rollers of the rollers of the fourth pair being perpendicular to the axes of the rollers of the third pair; the third and the fourth pair of the rollers simultaneously rolling said material to be rolled at the same point in the longitudinal direction of the material; and (C) a housing block in which the front four rollers and the back four rollers are installed within a sufficiently small distance that no guide is necessary therebetween and so that said material being rolled is directly passed from the front four rollers to the back four rollers;

wherein only one driving source is provided as a driving source for the rollers at rolling of said material to be rolled; the driving source drives any one roller of the front four rollers, and the remaining three rollers of the front four rollers and all the four rollers of the back four rollers are kept substantially fee rotating so that the free rotating rollers may rotate following advance of said material to be rolled.

2. An eight-roller type rolling mill according to claim 1; wherein driving sources of small driving force are provided so as to idle-rotate the three free rollers of the front four rollers and all the four free rollers of the back four rollers, which are free rotating, in the same rotating direction as that under rolling, prior to engagement of said material to be rolled by the rollers.

3. A method of finish-rolling round steel bars or steel wire using an eight-roller type rolling mill defined in claim 2; comprising: with use of rollers having peripheries which form a round hole corresponding to the final section of the product, supplying first said material to be rolled, which is provisionally rolled to a square bar, to the front four rollers to have the material engaged by the four rollers in such a manner that ridges of the square bar are positioned at the middle of width of the hole so as to roll down the ridges with the front four rollers, rolling down the remaining free surfaces of the bar with the back four rollers, and thus, finish-rolling the bar to give the final round section thereto.

4. A method of finish-rolling round steel bars or steel wire using an eight-roller type rolling mill defined in claim 1; comprising: with use of rollers having peripheries which form a round hole corresponding to the final section of the product, supplying first said material to be rolled, which is provisionally rolled to a square bar, to the front four rollers to have the material engaged by the four rollers in such a manner that ridges of the square bar are positioned at the middle of width of the hole so as to roll down the ridges with the front four rollers, rolling down the remaining free surfaces of the bar with the back four rollers, and thus, finish-rolling the bar to give the final round section thereto.

5. An eight-roller type rolling mill comprising:

(A) front four rollers comprising a first pair of rollers disposed oppositely with intermediation of a material to be rolled, axes of the rollers of the first pair being parallel, and a second pair of rollers disposed oppositely with intermediation of said material to be rolled at a same position as that of the rollers of the first pair in a longitudinal direction of said material to be rolled, axes of the rollers of the second pair being perpendicular to the axes of the rollers of the first pair; the first and the second pair of the rollers simultaneously rolling said material to be rolled at the same point in the longitudinal direction of the material;

(B) back four rollers installed in the down stream of the material being rolled comprising a third pair of rollers disposed oppositely with intermediation of said material to be rolled, axes of the rollers of the third pair being 45° inclined to those of the rollers of the first and the second pairs; and a fourth pair of rollers disposed oppositely with intermediation of said material to be further rolled at a same position as that of the rollers of the third pair in the longitudinal direction of said material, axes of the rollers of the rollers of the fourth pair being perpendicular to the axes of the rollers of the third pair; the third and the fourth pair of the rollers simultaneously rolling said material to be rolled at the same point in the longitudinal direction of the material; and (C) a housing block in which the front four rollers and the back four rollers are installed within a sufficiently small distance that no guide is necessary therebetween and so that said material being rolled is directly passed from the front four rollers to the back four rollers; and (D) a single driving means for driving the eight rollers, the driving means only driving one roller of the front four rollers and thereby rolling said material to be rolled, and the remaining three rollers of the front four rollers and all the four rollers of the back four rollers are free rotating so that the free rotating rollers rotate following advance of said material to be rolled.

6. An eight-roller type rolling mill comprising:

(A) front four rollers comprising a first pair of rollers disposed oppositely with intermediation of a material to be rolled, axes of the rollers of the first pair being parallel; and a second pair of rollers disposed oppositely with intermediation of said material to be rolled at a same position as that of the rollers of the first pair in a longitudinal direction of said material to be rolled, axes of the rollers of the second pair being perpendicular to the axes of the rollers of the first pair; the first and the second pair of the rollers simultaneously rolling said material to be rolled at the same point in the longitudinal direction of the material;

(B) back four rollers installed in the down stream of the material being rolled comprising a third pair of rollers disposed oppositely with intermediation of said material to be rolled, axes of the rollers of the third air being 45° inclined to those of the rollers of the first and the second pairs; and a fourth pair of rollers disposed oppositely with intermediation of said material to be further rolled at a same position as that of the rollers of the third pair in the longitudinal direction of said material, axes of the rollers of the rollers of the fourth pair being perpendicular to the axes of the rollers of the third pair; the third and the fourth pair of the rollers simultaneously rolling said material to be rolled at the same point in the longitudinal direction of the material;

(C) a housing block in which the front four rollers and the back four rollers are installed within a sufficiently small distance that no guide is necessary therebetween and so that said material being rolled is directly passed from the front four rollers to the back four rollers; and (D) driving means for driving the eight rollers, the driving means having a single main driving source for driving one roller of the front four rollers thereby rolling said material to be rolled, and smaller driving forces, which are smaller than the main driving source, for driving the remaining three rollers of the front four rollers and all the four rollers of the back four rollers, so that the remaining three rollers of the front four rollers and all the four rollers of the back four rollers idle rotate in the same rotating direction as that under rolling, prior to engagement of said material to be rolled by the rollers.

7. An eight-roller type rolling mill comprising:

(A) front four rollers comprising a first pair of rollers disposed oppositely with intermediation of a material to be rolled, axes of the rollers of the first pair being parallel, and a second pair of rollers disposed oppositely with intermediation of said material to be rolled at a same position as that of the rollers of the first pair in a longitudinal direction of said material to be rolled, axes of the rollers of the second pair being perpendicular to the axes of the rollers of the first pair; the first and the second pair of the rollers simultaneously rolling said material to be rolled at the same point in the longitudinal direction of the material;

(B) back four rollers installed in the down stream of the material being rolled comprising a third pair of rollers disposed oppositely with intermediation of said material to be rolled, axes of the rollers of the third pair being 45° inclined to those of the rollers of the first and the second pairs; and a fourth pair of rollers disposed oppositely with intermediation of said material to be further rolled at a same position as that of the rollers of the third pair in the longitudinal direction of said material, axes of the rollers of the rollers of the fourth pair being perpendicular to the axes of the rollers of the third pair; the third and the fourth pair of the rollers simultaneously rolling said material to be rolled at the same point in the longitudinal direction of the material; and (C) a housing block in which the front four rollers and the back four rollers are installed within a sufficiently small distance that no guide is necessary therebetween and so that said material being rolled is directly passed from the front four rollers to the back four rollers;

wherein two of the front four rollers have a diameter larger than a diameter of the other two front four rollers, and the rolling mill includes a single driving means for driving the eight rollers, the driving means having a main drive force only driving one of the larger rollers of the front four rollers and thereby rolling said material to be rolled, and the remaining three rollers of the front four rollers and all the four rollers of the back four rollers are free rotating so that the free rotating rollers rotate following advance of said material to be rolled.

* * * * *